United States Patent [19]

Yamaguchi et al.

[11] 4,205,912

[45] Jun. 3, 1980

[54] ELECTROPHOTOGRAPHIC APPARATUS

[75] Inventors: Yasuhiro Yamaguchi, Ryusen; Mamoru Baba, Kawasaki; Tetsuo Inoue; Mitsuaki Koyama, both of Yokohama, all of Japan

[73] Assignee: Tokyo Shibaura Electric Company, Limited, Kawasaki, Japan

[21] Appl. No.: 739,949

[22] Filed: Nov. 8, 1976

[30] Foreign Application Priority Data

Nov. 11, 1975 [JP] Japan ..... 50-135443

[51] Int. Cl.[2] ..... G03G 21/00

[52] U.S. Cl. ..... 355/15; 118/652; 355/3 CH; 355/3 TR

[58] Field of Search ..... 355/3 R, 15, 3 CH, 3 TR; 118/652

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 3,789,223 | 1/1974 | Sato | 250/325 |
| 3,879,785 | 4/1975 | Roth et al. | 355/15 X |
| 3,914,045 | 10/1975 | Namiki et al. | 355/15 |
| 3,918,808 | 11/1975 | Narita | 355/15 |
| 4,077,711 | 3/1978 | Akamatsu | 355/15 X |

OTHER PUBLICATIONS

Abbott et al.; "Xerographic System," IBM Technical Disclosure Bulletin, vol. 16, No. 9, Feb. 1974, p. 2958.

Noto, Fedele A.; "Copier with Single Corona Generating Device," Xerox Disclosure Journal, vol. 1, No. 2, Feb. 1976, p. 93.

*Primary Examiner*—Fred L. Braun

*Attorney, Agent or Firm*—Oblon, Fisher, Spivak, McClelland & Maier

[57] ABSTRACT

An electrophotographic apparatus includes a photoconductive drum capable of rotating at least two rotations during a series of copying processes, a first charging device for charging the surface of the drum in a negative polarity, a first exposing device, a development device having a magnetic brush unit, and a second charging device for transferring image. A second exposing device is provided to expose the entire surface of the photoconductive drum together with the residual toner after the image transfer process during the second rotation of the photoconductive drum. A third charging device is provided to supply positive charges to the surface of the drum and the residual toner after the second exposure. The residual toner is removed from the photoconductive drum by the above described magnetic brush unit charged in the same negative polarity with that of the first charging device and the image transfer device.

1 Claim, 10 Drawing Figures

ELECTROPHOTOGRAPHIC APPARATUS

The present invention relates generally to an electrophotographic apparatus, more particularly, to the one capable of executing a series of copying processes every two rotations of a photoconductive drum, called one copy-two rotation type.

In a prior art electrographic apparatus a cleaning device for cleaning the surface of a photoconductive drum is comprised of a fur-brush. The fur-brush is largely worn and required to be frequently replaced resulting in an increase in copy cost. There has been found, therefore, the apparatus using a development device in place of the fur-brush to permit it to carry out the cleaning operation as well as the developing operation. Such apparatus is called one copy-two rotation type wherein a single magnetic brush is used for the development and the cleaning. In the electrophotographic apparatus, charging, exposure and development steps are carried out in the first rotation of the drum, and transfer, removal and cleaning of toner in the second rotation. In a prior art photographic apparatus disclosed in, for example, a Japanese Patent Application Disclosure No. 122938/75. The photoconductive drum is charged in the negative polarity and, in the image exposure stage, latent image with negative polarity is formed onto the surface of the photoconductive drum by an exposure device. The negatively-charged latent image is developed by the positively charged toner attached to the magnetic brush of a magnetic brush device biased negatively, and the toner image formed is transferred to a copy sheet negatively-charged. Then, the residual toner on the photoconductive drum negatively-charged in the transferring stage is positively-charged, by a charging device impressed with a positive voltage. In other words, the toner is charged in the same polarity as that when it is developed. Following this, the entire surface of the photoconductive drum onto which the residual toner is attached is positively charged and exposed, and residual toner is removed from the photoconductive drum surface by means of the same magnetic brush used at the development stage, i.e. the magnetic brush negatively biased.

Thus, the described copying apparatus enjoys a merit that the copying mechanism is simplified by reason that a single and identical magnetic brush may be used both for the development and cleaning. Regrettably, in the copying apparatus, a satisfactorily cleaning effect is expected only when a high bias votage is applied to the magnetic brush. The reason for this will be described later. When the bias voltage to be applied to the magnetic brush device is low, fog occurs on the non-imaged portion or white portion of the image copied and a poor cleaning is obtained. On the other hand, when a high bias voltage is applied to the brush device, no fog occurs and an excellent cleaning is obtained. The high bias voltage applied, however, provides the low iamge density of the image. Thus, the improvement of the cleaning effect results in the deterioration of the image density. This fact places a restriction of both the improvement of cleaning effect and the increasing of the image density. The result of our investigation of the cleaning phenomenon made clear the reason why the high voltage of bias must be applied in the conventional cleaning device. Investigation was made of the charging conditions of the photoconductive drum and the toner in the case where the positive charging and the entire exposure are performed after the image transfer. As a result of the investigation, the fact was made clear that the photoconductive layer on the drum, particularly the photoconductive layer corresponding to the non-transferred region, after the entire exposure, is induced in the polarity opposite to that of the toner, i.e. negative polarity. This is the answer for the above mentioned question. More precisely, we described transferring the toner image to a copy sheet of which the size is smaller than that of the original document. More than 80% of the toner on the portion of the drum which faces the copy sheet, is transferred to the copy sheet and it is easy to clean the residual toner on the portion of the drum. The residual toner, especially, on the other portion of the drum, cannot be easily cleaned. Electric charge of the residual toner is changed from positive polarity (intrinsic polarity) to negative polarity with the second charging device operated at a negative potential at the transfer stage. When the photoconductive layer to which negatively-charged toner adheres is entirely charged in positive polarity in second charging, the toner is positively-charged again. At this time, the photoconductive layer facing the residual toner exhibits negative polarity. Then, the photoconductive surface is entirely exposed by light, with the result that the electric charges on the photoconductive layer are completely removed, except those on the region of the photoconductive layer which faces the residual toner with positive polarity. As seen from this, the positively-charged residual toner is attracted by the negative charges induced on the region of the photoconductive surface facing the residual toner. Consequently, the removal of the residual toner from the photoconductive layer requires a high bias voltage for the magnetic brush device, for ensuring a satisfactory cleaning of toner.

Accordingly, an object of the present invention is to provide an electrophotographic apparatus capable of enhancing cleaning effect without decreasing image density.

Another object of the present invention is to provide an electrophotographic apparatus capable of performing cleaning and development by using a magnetic brush.

An electrophotographic apparatus according to the present invention comprises: a photoconductive drum making two rotations during a series of copying processes; a first charging device for charging in a predetermined polarity the surface of the photoconductive drum; a first exposing device for exposing the photoconductive drum to form an electrostatic latent image corresponding to an original image on the surface of the photoconductive drum charged; a developing device including a magnetic brush for supplying the toner charged in opposite polarity to the latent image in order to visualize the latent image; a second charging device for transferring, applied with the same potential-polarity as that of the first charging device for transferring the residual developing image to a copy sheet; a second exposing device for entirely exposing the surface of the photoconductive drum with the residual toner image thereon after transferring process; and a third charging device for charging the toner of the residual toner image as well as the photoconductive drum in the polarity opposite to that of the bias voltage supplied to the transfer device at the transfer process; the toner charged in the opposite polarity by the second charging device, being electrostatically removed by the magnetic brush included in the developing device.

This invention can be more fully understood from the following detailed description when taken in conjunction with the accompanying drawings, in which.

Figure 1:
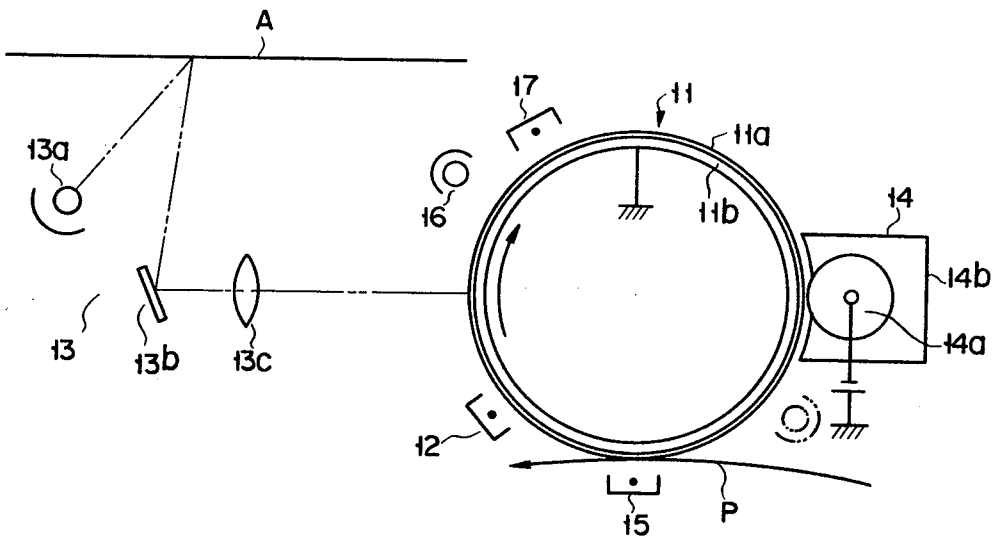
FIG. 1 is a schematic diagram of an electrophotographic apparatus according to an embodiment of the present invention.

Reference is now made to FIG. 1 illustrating schematically an electrophotographic apparatus according to the present invention. In the drawing, a photoconductive drum 11 comprises a drum body 11*b* with a photoconductive layer 11*a* disposed therearound. When the photoconductive drum makes a first rotation, the surface of the photoconductive drum 11, i.e. the photoconductive layer 11*a*, is uniformly charged in DC negative polarity by means of a first charging device 12, for example, a corona generating device. The photoconductive layer 11*a* charged in DC negative polarity is exposed by a first exposing means comprising a light source 13*a*, a reflection mirror 13*b*, and a condensing lens 13*c*. Through the exposure, the electrostatic latent image corresponding to the image of the original document A to be copied is formed on the photoconductive layer 11*a*. In this case, the latent image is charged negatively. When, according to the rotating of the photoconductive drum 11, the latent image passes through a development device 14, the latent image is visualized. The development device 14 is comprised of a magnetic brush unit 14*a* applied with a DC negative bias voltage and a toner container storing positively charged toner. The development by the development device 14 is made in a manner that the magnetic brush of the magnetic brush unit makes the positively-charged toner contact the photoconductive layer and the toner is electrostatically attracted onto the negative electric charges of the latent image on the drum. When the drum surface with this toner image comes in contact with the copy sheet P and DC negative charges are applied to the photoconductive drum from the reverse side of the paper sheet P by means of a transferring device 15 comprised of a second corona generating device similar to the charging device 12 and biased by a DC negative voltage, the toner image is transferred to the copy sheet P. The transferring device may be comprised of the same corona generating device as the charging device. After transferring, the surface of the photoconductive drum 11 progressing of the second rotation, is entirely exposed by a second exposing device 16 comprising a tungsten lamp, with the result that the latent image remaining on the photoconductive drum 11 is mostly erased. Following the second exposure, the drum surface is charged in the DC positive polarity by means of a third charging device 17 comprising a corona generating device, the polarity at this time being reverse to that at the transfer process. At this process, the residual toner charged negatively at the transfer process is charged positively again. When the positively-charged residual toner passes through the magnetic brush device, the residual toner is electrostatically attracted to the magnetic brush with the negative bias voltage. As a result of this, the surface of the photoconductive surface 11 is cleaned. That is, the magnetic brush device 14 is used both for the cleaning and development.

Figure 2A:
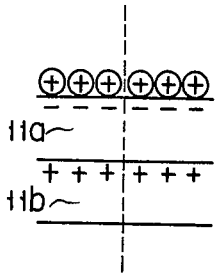
FIGS. 2A to 2G illustrate the charging conditions of the toner and photoconductive drum near the cleaning stage.
Figure 2B:
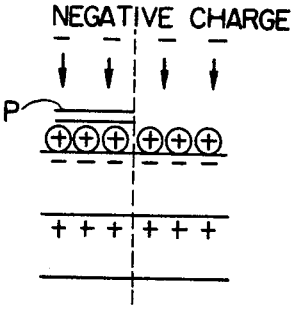
Figure 2C:
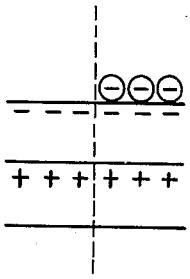
Figure 2D:
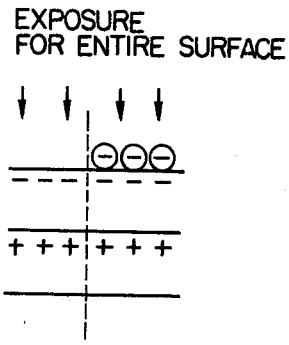
Figure 2E:
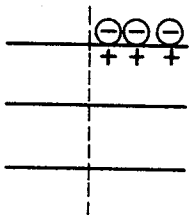
Figure 2F:
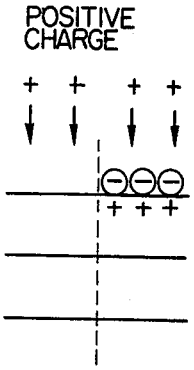
Figure 2G:
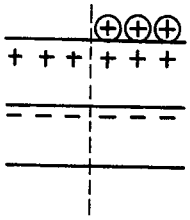

The explanation to follow is the reason why, in the electrophotographic process according to the present invention, a satisfactory cleaning is obtained even if the bias voltage to be applied to the magnetic brush device is slightly lower. The explanation will be given using the case where the original document is larger than the copy sheet. FIG. 2A shows the charging conditions of the photoconductive drum 11 and the toner thereon immediately after a development process. As seen from the figure, the photoconductive layer 11*a* is negatively-charged and the positive charged toner is electrostatically attracted on the layer 11*a*. Under this condition, when a negative charging is performed as shown in FIG. 2B in order to transfer the charged toner to a copy sheet smaller than an original document, the residual toner on the portion of the photoconductive layer 11*a* which does not contact the copy sheet P, is negatively-charged, as shown in FIG. 2C. Then, the entire surface of the photoconductive layer 11*a* including the residual toner is exposed as shown in FIG. 2D. At this second exposure, positive charges are induced to the photoconductive layer 11*a* under negatively-charged residual toner and charges on the remaining portion of the photoconductive layer 11*a* are removed, as shown in FIG. 2E. Under this condition, positive charges are supplied to the photoconductive drum 11 by means of the third charging device 17 as shown in FIG. 2F and thus the photoconductive layer 11*a* as well as the residual toner is positively charged. As the result, the positively-charged toner is repelled by positive charges on the photoconductive layer 11*a*. Accordingly, after this, when the residual toner is removed by the magnetic brush device, the surface of the photoconductive drum is fully cleaned even with a lower bias voltage to be applied to the magnetic brush device.

Experiment was made for investigating the removal condition of the residual toner on the photoconductive layer after transfer, i.e. the cleaning condition of the photoconductive layer, on the bias of the relationship between the DC positive charging voltage of the third charging device and the DC negative bias voltage of the magnetic brush device.

In this experiment, the photoconductive layer used is made of material photosensitive to both negative and positive polarities, such as a combination of poly-n-vinylcarbazole (PVC) and trinitrofluorenone (TNF), the toner at the development stage is positively charged, and the DC negative charging voltage at the transfer process, is set from −5 kV to −6 KV. Under this condition, the DC positive charging voltage of the third charging device is varied from 4.5 kV to 6 kV and the bias voltage to be applied to the magnetic brush device is varied from −100 V to −250 V.

Figure 3:
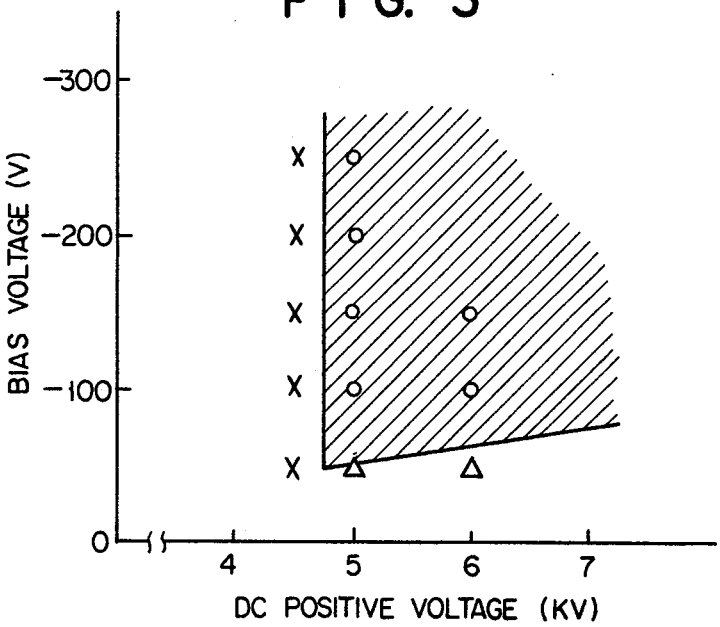
FIG. 3 is a graph for explaining the cleaning effect drafted on the basis of the relationship of second charging voltage vs. bias voltage applied to the magnetic brush.

As a result of this experiment, the cleaning condition is obtained as shown in FIG. 3. In the figure, symbol o indicates cleaning possible, symbol x cleaning impossible, and symbol Δ partly cleaning possible. As seen from the figure, the cleaning of the photoconductive drum is possible when the bias voltage is more than −100 V and the DC positive charging voltage is more than 5 kV. Also, the experiment confirmed that the cleaning by the conventional electrophotographic process requires more than −220 V for the bias voltage and more than 6 kV for the DC positive charging voltage. Accordingly, the electrophotographic apparatus according to the present invention provides a satisfactory effect of cleaning with lower bias voltage than that of the conventional one. Thus, if the bias voltage is properly selected, high image density is obtained and good cleaning is attained.

Figure 4:
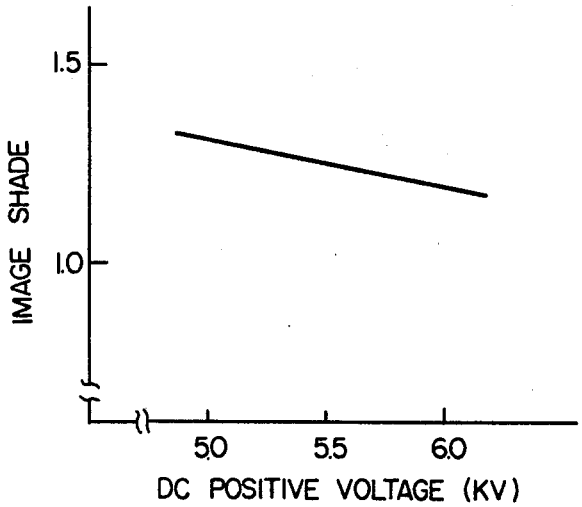
FIG. 4 illustrates the relationship between second charging voltage and image density.

In the electrophotographic process of the present invention, the surface of the photoconductive drum, before cleaning, is positively-charged by the third charging device and thus if the photoconductive drum is charged in the DC negative polarity by the first charging device in the subsequent copying process, the drum is insufficiently charged negatively. For this, the image density becomes in the subsequent copying processes slightly low. From FIG. 4 illustrating the relationship of the image density and DC positive voltage for the third charging device, it will be understood that the image density decreases as the DC positive charging voltage increases. It is apparent from FIG. 3 that 5 kV to 6 kV of the DC positive charging voltage provides a satisfactory cleaning effect. When those voltages are applied to the graph of FIG. 4, 1.3 of the iamge density is obtained for 5 kV of the DC positive voltage and 1.2 for 6 kV. However, such values of image density are not problematic in practical use. If further higher density is desired, the photoconductive layer, after cleaning, is entirely exposed by a third exposing device (indicated by the alternate long and two short dashes line shown in FIG. 1) for removing the charges on the photoconductive drum.

As mentioned above, according to the present invention, after the transfer process, the entire surface of the photoconductive drum is uniformly exposed and then that surface is charged in the polarity opposite to that of the development process. Through such a process, the cleaning process to follow enables the photoconductive drum to be satisfactorily cleaned by using the magnetic brush device with such a bias voltage applied thereto as to have a value giving a satisfactory image density without any fog.

What we claim is:

1. An electrophotographic apparatus comprising:

a photoconductive drum having a surface and making at least two rotations during a series of copying processes;

a first charging device for uniformly charging the surface of said photoconductive drum in one polarity during a first rotation of said photoconductive drum;

a first exposing device for exposing said photoconductive drum in order to form on the surface of said drum an electrostatic latent image corresponding to an original image pattern;

a developing device for visualizing the latent image during the first rotation of said drum comprising a magnetic brush unit supplied with a bias voltage of the one polarity and feeding toner charged in the other polarity opposite to the polarity of the latent image to form a toner image;

said first charging device being impressed with a voltage of the one polarity and operating as a transferring unit for transferring the toner image formed by said developing device to a copy sheet during the second rotation of said drum;

a second exposing device for exposing the entire surface of said drum; and a second charging device for charging in the other polarity the residual toner charged in the one polarity in the image by said first charging device so that said magnetic brush unit electrically attracts the residual toner charged in the other polarity by said second charging device during the second rotation of said drum in order to clean said drum.

* * * * *